US011749446B2

(12) United States Patent
Hashimoto et al.

(10) Patent No.: US 11,749,446 B2
(45) Date of Patent: Sep. 5, 2023

(54) COMMON-MODE CHOKE COIL

(71) Applicant: Murata Manufacturing Co., Ltd., Kyoto-fu (JP)

(72) Inventors: Ryota Hashimoto, Nagaokakyo (JP); Takashi Sukegawa, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 1086 days.

(21) Appl. No.: 16/264,189

(22) Filed: Jan. 31, 2019

(65) Prior Publication Data

US 2019/0272940 A1 Sep. 5, 2019

(30) Foreign Application Priority Data

Mar. 3, 2018 (JP) ..... 2018-038109

(51) Int. Cl.
*H01F 27/28* (2006.01)
*H01F 17/04* (2006.01)
*H01F 17/00* (2006.01)

(52) U.S. Cl.
CPC ..... *H01F 27/2823* (2013.01); *H01F 17/04* (2013.01); *H01F 17/045* (2013.01); *H01F 2017/0093* (2013.01); *H01F 2027/2838* (2013.01)

(58) Field of Classification Search
CPC . H01F 17/04; H01F 17/045; H01F 2017/0093
See application file for complete search history.

(56) References Cited

U.S. PATENT DOCUMENTS

2004/0263285 A1* 12/2004 Suzuki ..... H01F 41/082 333/185
2014/0070914 A1* 3/2014 Oki ..... H01F 41/0206 336/233
2016/0133377 A1* 5/2016 Takagi ..... H01F 27/29 29/605
2016/0240305 A1* 8/2016 Igarashi ..... H01F 27/2828
2017/0025212 A1* 1/2017 Jerez ..... H01F 41/07
(Continued)

FOREIGN PATENT DOCUMENTS

CN 103887041 A * 6/2014
CN 103887041 A 6/2014
(Continued)

OTHER PUBLICATIONS

An Office Action issued by the China National Intellectual Property Administration dated Aug. 28, 2020, which corresponds to Chinese Patent Application No. 201910058211.3 and is related to U.S. Appl. No. 16/264,189 with English language translation.

*Primary Examiner* — Marlon T Fletcher
*Assistant Examiner* — Malcolm Barnes
(74) *Attorney, Agent, or Firm* — Studebaker & Brackett PC

(57) ABSTRACT

A common-mode choke coil is configured such that in one turn of a stranded portion, a number of times a first wire is disposed outside a second wire on a first side surface of a core is equal to a number of times the second wire is disposed outside the first wire on a second side surface that is opposite to the first side surface. Also, a number of times the first wire is disposed outside the second wire on a top surface of the core is equal to a number of times the second wire is disposed outside the first wire on a bottom surface that is opposite to the top surface.

21 Claims, 5 Drawing Sheets

(56) References Cited

U.S. PATENT DOCUMENTS

| | | | | |
|---|---|---|---|---|
| 2017/0069425 | A1* | 3/2017 | Yamakita | H01F 41/076 |
| 2017/0301455 | A1* | 10/2017 | Kobayashi | H01F 27/2823 |
| 2019/0019612 | A1* | 1/2019 | Kawasaki | H01F 41/10 |
| 2020/0013534 | A1* | 1/2020 | Dinh | H01F 41/07 |

FOREIGN PATENT DOCUMENTS

| | | | | |
|---|---|---|---|---|
| JP | 2005322820 | A | * | 11/2005 |
| JP | 2014-216525 | A | | 11/2014 |

* cited by examiner

COMMON-MODE CHOKE COIL

CROSS-REFERENCE TO RELATED APPLICATION

This application claims benefit of priority to Japanese Patent Application No. 2018-038109, filed Mar. 3, 2018, the entire content of which is incorporated herein by reference.

BACKGROUND

Technical Field

The present disclosure relates to common-mode choke coils, and more particularly to a common-mode choke coil having a structure in which two wires are twisted together and wound around a core.

Background Art

Japanese Unexamined Patent Application Publication No. 2014-216525, for example, describes a common-mode choke coil of interest to the present disclosure. The common-mode choke coil described in Japanese Unexamined Patent Application Publication No. 2014-216525 has a structure in which a first wire and a second wire are twisted together to form a stranded portion that is wound around a core. According to Japanese Unexamined Patent Application Publication No. 2014-216525, by twisting the first and second wires together to form the strand portion, the stray capacitance between the first and second wires can be reduced, and reduction in the coupling coefficient between the coil formed of the first wire and the coil formed of the second wire can be suppressed.

SUMMARY

According to Japanese Unexamined Patent Application Publication No. 2014-216525, the number of times the first and second wires are twisted is two or more (see, for example, claim 3). However, Japanese Unexamined Patent Application Publication No. 2014-216525 does not describe in detail the manner in which the first and second wires are twisted together.

An ordinary twisted pair cable includes wires having sufficient strength. Unlike the wires included in a twisted pair cable, wires included in a small coil component more easily break as the number of twist increases. Therefore, in practice, the number of twist needs to be as small as several times per turn.

Accordingly, there is a risk that appropriate electrical balance cannot be achieved between the first and second wires. More specifically, assuming that the core has a quadrangular cross section and has peripheral surfaces including top and bottom surfaces and first and second side surfaces, the number of times the first wire faces outward (or is disposed under the second wire) on the top surface may differ from the number of times the second wire faces outward (or is disposed under the first wire) on the bottom surface that is opposite to the top surface. Also, the number of times the first wire faces outward (or is disposed under the second wire) on the first side surface may differ from the number of times the second wire faces outward (or is disposed under the first wire) on the second surface that is opposite to the first surface.

As a result, the stray capacitance generated in relation to the first wire and the stray capacitance generated in relation to the second wire may differ from each other. In such a case, signals transmitted through the first and second wires are influenced by non-equivalent inductances and capacitances. This may lead to degradation of the mode conversion characteristics of the common-mode choke coil.

Accordingly, the present disclosure is to provide a common-mode choke coil in which first and second wires are twisted together in such a manner that the mode conversion characteristics can be improved.

A common-mode choke coil according to an embodiment of the present disclosure including a core having a shape that extends along a center axis and including peripheral surfaces around the center axis. The peripheral surfaces include a first surface and a second surface that are opposite to each other, and a third surface and a fourth surface that are adjacent to the first surface and the second surface and opposite to each other. The common-mode choke coil further includes a first wire and a second wire that are wound around the peripheral surfaces in same direction, that are not electrically connected to each other, and that are twisted together into a stranded portion.

In one turn of the stranded portion of the common-mode choke coil, a number of times the first wire is disposed outside the second wire on the first surface is equal to a number of times the second wire is disposed outside the first wire on the second surface. Also, a number of times the first wire is disposed outside the second wire on the third surface is equal to a number of times the second wire is disposed outside the first wire on the fourth surface.

In this specification, the positional relationship between the first and second wires is referred to as being "symmetrical" when the number of times the first wire is disposed outside the second wire on one of two opposite surfaces is equal to the number of times the second wire is disposed outside the first wire on the other of the two opposite surfaces, as described above. The first, second, third, and fourth surfaces are defined relative to each other, and may correspond to any of top and bottom surfaces and two side surfaces included in the peripheral surfaces of the core.

According to the embodiment of the present disclosure, preferably, in a plurality of turns of the stranded portion, a number of times the first wire is disposed outside the second wire on the first surface is equal to a number of times the second wire is disposed outside the first wire on the second surface. Also, a number of times the first wire is disposed outside the second wire on the third surface is equal to a number of times the second wire is disposed outside the first wire on the fourth surface.

According to this structure, the number of turns for which the positional relationship between the first and second wires is symmetrical increases. Therefore, the inductances and capacitances of the first and second wires are more equivalent.

The first and second wires are preferably symmetrical in substantially all of the turns. The reason why the first and second wires are described as being preferably symmetrical in "substantially all of the turns" instead of "all of the turns" is because it is difficult to twist the first and second wires as specified from the winding start point to the winding end point.

According to the embodiment of the present disclosure, preferably, a number of twist of the stranded portion is two or less on each of the first, second, third, and fourth surfaces. With this structure, the wires can be twisted with low residual stress, and therefore the mechanical strength and long-term reliability of the wires can be increased.

According to the embodiment of the present disclosure, the core typically has a substantially quadrangular shape in cross section perpendicular to the center axis. However, the following modifications are also possible.

As a first modification, the first surface may be outwardly curved in cross section perpendicular to the center axis of the core.

As a second modification, the first surface may be outwardly bent in cross section perpendicular to the center axis of the core.

In each of the above-described first and second modifications, the second surface may be straight in cross section perpendicular to the center axis of the core, or be symmetrical to the first surface in cross section perpendicular to the center axis.

According to the embodiment of the present disclosure, the first and second wires are arranged so that the signals transmitted therethrough are influenced by inductances and capacitances that are close to each other. Accordingly, a common-mode choke coil having electrical characteristics with good mode conversion characteristics can be provided.

Other features, elements, characteristics and advantages of the present disclosure will become more apparent from the following detailed description with reference to the attached drawings.

DETAILED DESCRIPTION

A common-mode choke coil 1 according to a first embodiment of the present disclosure will be described with reference to FIGS. 1 to 5.

Figure 1:
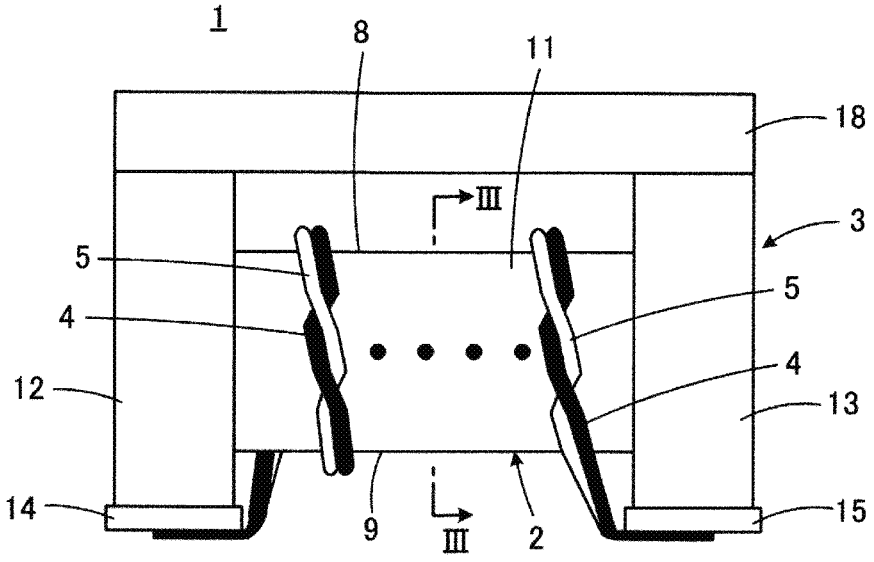
FIG. 1 is a front view of a common-mode choke coil according to a first embodiment of the present disclosure.
Figure 2:
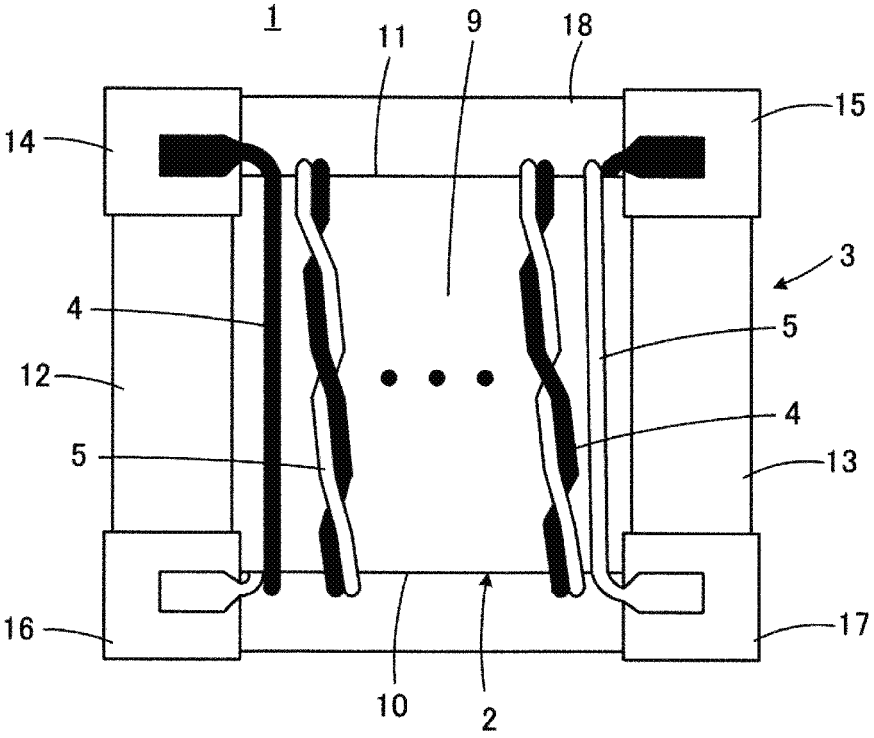
FIG. 2 is a bottom view of the common-mode choke coil illustrated in FIG. 1.
Figure 3:
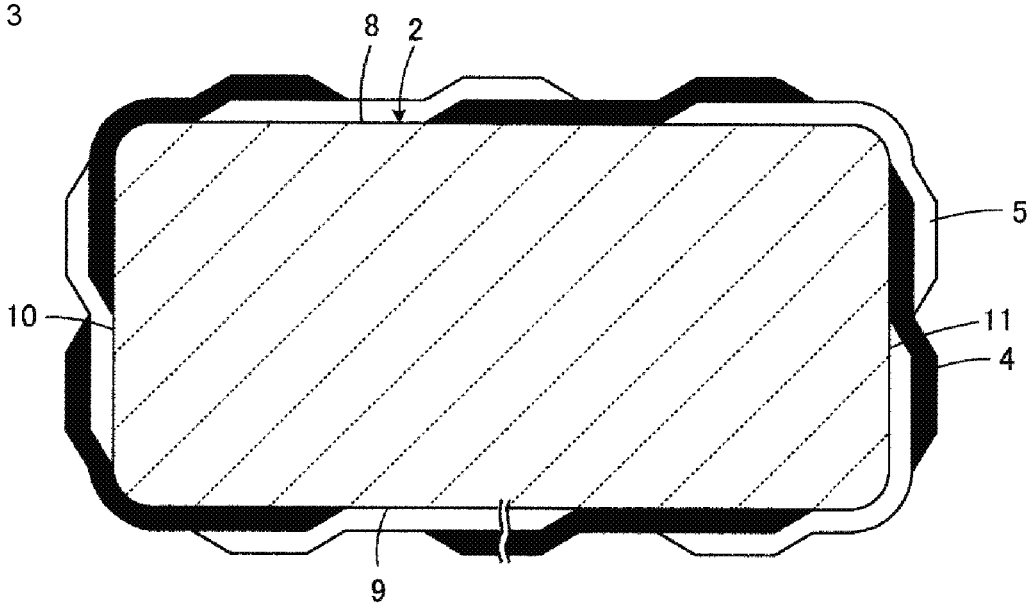
FIG. 3 illustrates the manner in which first and second wires wound around a core of the common-mode choke coil illustrated in FIG. 1 are twisted together on a plane taken along line in FIG. 1.

The common-mode choke coil 1 includes a drum-shaped core member 3 having a core 2. The common-mode choke coil 1 also includes a first wire 4 and a second wire 5 arranged around the core 2. In FIGS. 1 to 3, the first wire 4 is shown in black and the second wire 5 is shown in white to make the first wire 4 and the second wire 5 clearly distinguishable.

The drum-shaped core member 3 is made of a non-conductive material, more specifically, a non-magnetic material such as alumina, a magnetic material such as Ni—Zn-based ferrite, or a resin. The resin may be, for example, a resin containing magnetic powder, such as metal powder or ferrite powder, a resin containing a non-magnetic material, such as silica powder, or a resin containing no filler such as powder. The wires 4 and 5 are, for example, copper wires having a diameter in the range from 0.02 mm to 0.080 mm covered with an electrically insulating resin such as polyurethane, imide-modified polyurethane, polyesterimide, or polyamide-imide.

As illustrated in FIG. 3, the core 2 is shaped to extend along a center axis, and has a quadrangular shape in cross section perpendicular to the center axis. More specifically, the peripheral surfaces of the core 2 around the center axis include a top surface 8 and a bottom surface 9 that are opposite to each other, and a first side surface 10 and a second side surface 11 that are adjacent to the top surface 8 and the bottom surface 9 and are opposite to each other. The first side surface 10, the second side surface 11, the top surface 8, and the bottom surface 9 are examples of a first surface, a second surface, a third surface, and a fourth surface, respectively.

The drum-shaped core member 3 includes first and second flange portions 12 and 13 that are respectively connected to first and second end portions of the core 2 at opposite ends of the core 2. First and third terminal electrodes 14 and 16 are provided on the first flange portion 12, and second and fourth terminal electrodes 15 and 17 are provided on the second flange portion 13. The terminal electrodes 14 to 17 are provided on the surfaces of the flange portions 12 and 13 that face in the same direction as the bottom surface 9 of the core 2. The terminal electrodes 14 to 17 are formed by, for example, baking conductive paste, plating conductive metal, or attaching conductive metal pieces. In the case where the terminal electrodes 14 to 17 are formed by baking conductive paste, conductive paste containing silver as a conductive component, for example, may be used as the conductive paste to be baked. In addition, the baked conductive paste is successively plated with copper, nickel, and tin as appropriate.

End portions of the first wire 4 are connected to the first and second terminal electrodes 14 and 15 by, for example, thermocompression bonding or laser welding. End portions of the second wire 5 are connected to the third and fourth terminal electrodes 16 and 17 by, for example, thermocompression bonding or laser welding.

The common-mode choke coil 1 may further include a plate-shaped core member 18. Similar to the drum-shaped core member 3, the plate-shaped core member 18 may also be made of, for example, a non-magnetic material such as alumina, a magnetic material such as Ni—Zn-based ferrite, or a resin. Also for the plate-shaped core member 18, the resin may be, for example, a resin containing magnetic powder, such as metal powder or ferrite powder, a resin containing non-magnetic material, such as silica powder, or a resin containing no filler such as powder. In the case where the drum-shaped core member 3 and the plate-shaped core member 18 are made of a magnetic material, the plate-shaped core member 18 may be arranged to connect the first and second flange portions 12 and 13 so that the drum-shaped core member 3 and the plate-shaped core member 18 form a closed magnetic circuit.

Most parts of the first wire 4 and the second wire 5 excluding the end portions connected to the above-described terminal electrodes 14 to 17 and portions near the end portions are twisted together to form a stranded portion. Normally, the first wire 4 and the second wire 5 are twisted together while being wound around the core 2. The first wire 4 and the second wire 5 that form the stranded portion are helically wound substantially the same number of turns around the core 2 in the same direction. As above-described, the first wire 4 and the second wire 5 are covered with an insulating material, and are therefore not electrically connected to each other. The first wire 4 and the second wire 5 may include portions that are not twisted together in regions outside the end portions connected to the terminal electrodes 14 to 17 and portions near the end portions.

Figure 4A:
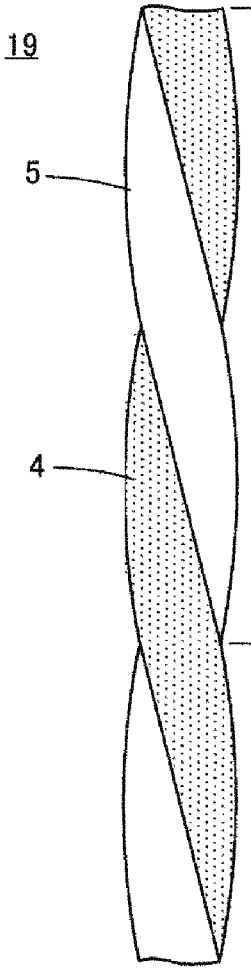
FIG. 4A is an enlarged view illustrating the manner in which the first and second wires are twisted together.
Figure 4B:
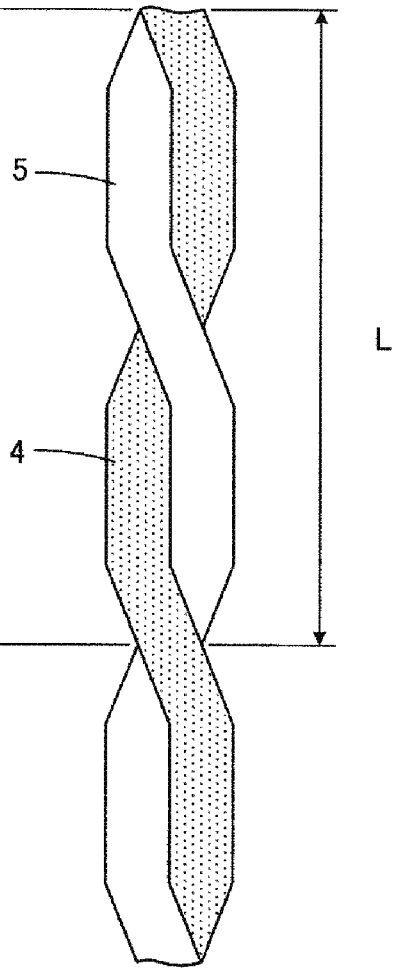
FIG. 4B is a schematic diagram of the first and second wires illustrated in the same way as in FIGS. 1 and 2.

FIGS. 4A and 4B schematically illustrate a stranded portion 19 formed of the two wires 4 and 5 illustrated in FIGS. 1 and 2. FIG. 4A is an enlarged front view of the stranded portion 19 obtained by twisting the first wire 4 and the second wire 5 together. FIG. 4B is a schematic diagram of the first wire 4 and the second wire 5 illustrated in FIG. 4A drawn with straight lines. In FIGS. 4A and 4B, the first wire 4 is shaded and the second wire 5 is shown in white to make the first wire 4 and the second wire 5 clearly distinguishable.

Although the stranded portion 19 illustrated in FIGS. 4A and 4B has a Z-twist, the stranded portion 19 may instead be twisted in the opposite direction and have an S-twist. Alternatively, the stranded portion 19 may have a mixture of Z-twist and S-twist. In addition, although the first wire 4 and the second wire 5 that are twisted together are in contact with each other in FIGS. 4A and 4B, the first wire 4 and the second wire 5 may instead have partial gaps therebetween.

Referring to FIGS. 4A and 4B, it is assumed that a peripheral surface of the core 2 is located behind the first wire 4 and the second wire 5. As illustrated in FIGS. 4A and 4B, when viewed in a direction toward the peripheral surface of the core 2, the first wire 4 and the second wire 5 are twisted 360 degrees in a range of length L of the stranded portion of the first wire 4 and the second wire 5. Thus, the number of twist of the first wire 4 and the second wire 5 in the range of length L is 1. In the range of length L, the second wire 5 shown in white is above the first wire 4 that is shaded.

Similar to FIG. 4B, in FIG. 3 showing the core 2 in cross section, the first wire 4 and the second wire 5 are schematically drawn with straight lines. As is clear from FIG. 3, the first wire 4 and the second wire 5 are arranged next to each other on four ridges between the first side surface 10, the top surface 8, the second side surface 11, and the bottom surface 9 of the core 2. Accordingly, the first wire 4 and the second wire 5 can be wound around the core 2 in a stable manner so that the common-mode choke coil 1 has stable electrical characteristics.

Figure 5:
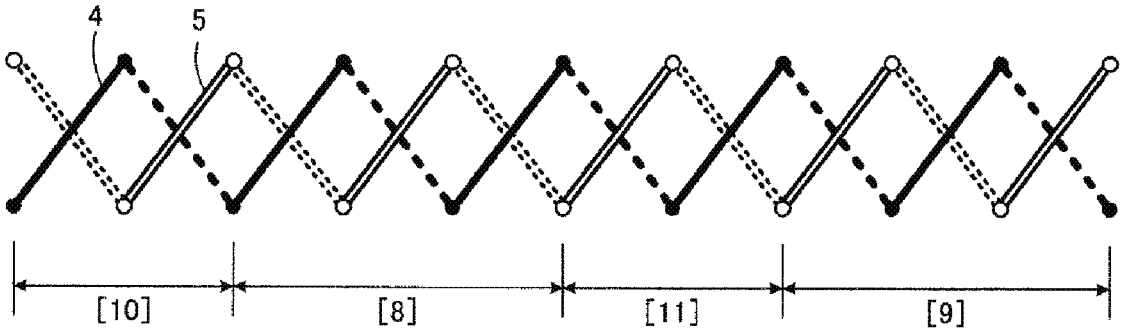
FIG. 5 is a schematic diagram illustrating the manner in which the first and second wires of the common-mode choke coil illustrated in FIG. 1 are twisted together on the peripheral surfaces of the core in a developed state.

FIG. 5 is a schematic diagram illustrating the manner in which the first wire 4 and the second wire 5 are twisted together on the peripheral surfaces of the core 2 in the order of the first side surface 10, the top surface 8, the second side surface 11, and the bottom surface 9 in a developed state. In FIG. 5, the bold lines represent the first wire 4 and the double lines represent the second wire 5. In each intersection between the first wire 4 and the second wire 5, one of the wires that is above the other is drawn with solid lines, and one of the wires that is below the other is drawn with broken lines.

Referring to FIG. 5, on the first side surface 10, the first wire 4 and the second wire 5 are twisted 360 degrees and the number of twist is 1, which is a multiple of 0.5. The number of times the first wire 4 is disposed outside the second wire 5 is one, and the number of times the second wire 5 is disposed outside the first wire 4 is one.

On the top surface 8, the first wire 4 and the second wire 5 are twisted 540 degrees and the number of twist is 1.5, which is a multiple of 0.5. The number of times the first wire 4 is disposed outside the second wire 5 is two, and the number of times the second wire 5 is disposed outside the first wire 4 is one.

On the second side surface 11, the first wire 4 and the second wire 5 are twisted 360 degrees and the number of twist is 1, which is a multiple of 0.5. The number of times the first wire 4 is disposed outside the second wire 5 is one, and the number of times the second wire 5 is disposed outside the first wire 4 is one.

On the bottom surface 9, the first wire 4 and the second wire 5 are twisted 540 degrees and the number of twist is 1.5, which is a multiple of 0.5. The number of times the first wire 4 is disposed outside the second wire 5 is one, and the number of times the second wire 5 is disposed outside the first wire 4 is two.

The above-described arrangement has the following features.

With regard to the first side surface 10 and the second side surface 11 that are opposite to each other, the number of times the first wire 4 is disposed outside the second wire 5 on the first side surface 10 is one, and is equal to the number of times the second wire 5 is disposed outside the first wire 4 on the second side surface 11. From another point of view, the number of times the first wire 4 is disposed outside the second wire 5 on the second side surface 11 is one, and is equal to the number of times the second wire 5 is disposed outside the first wire 4 on the first side surface 10.

Also, with regard to the top surface 8 and the bottom surface 9 that are opposite to each other, the number of times the first wire 4 is disposed outside the second wire 5 on the top surface 8 is two, and is equal to the number of times the second wire 5 is disposed outside the first wire 4 on the bottom surface 9. From another point of view, the number of times the first wire 4 is disposed outside the second wire 5 on the bottom surface 9 is one, and is equal to the number of times the second wire 5 is disposed outside the first wire 4 on the top surface 8.

On the top surface 8 and the bottom surface 9, the total number of times the first wire 4 is disposed outside the second wire 5 and the total number of times the second wire 5 is disposed outside the first wire 4 are both three. Similarly, on the first and second side surfaces 10 and 11, the total number of times the first wire 4 is disposed outside the second wire 5 and the total number of times the second wire 5 is disposed outside the first wire 4 are both two.

The wires 4 and 5 are preferably wound around the peripheral surfaces of the core 2 while the wires 4 and 5 are twisted in the above-described manner by using a winding device capable of changing the number of twist per unit length for each of the first side surface 10, the top surface 8, the second side surface 11, and the bottom surface 9. More specifically, the winding device is capable of changing the twisting speed and winding speed for each of the first side surface 10, the top surface 8, the second side surface 11, and the bottom surface 9.

In the above-described arrangement, the positional relationship between the first wire 4 and the second wire 5 on one of two surfaces that are opposite to each other is symmetrical to the positional relationship between the first wire 4 and the second wire 5 on the other of the two surfaces. In such a case, the signals transmitted through the first wire 4 and the second wire 5 are influenced by equivalent inductances and capacitances. Thus, the common-mode choke coil 1 has electrical characteristics with good mode conversion characteristics.

The first wire 4 and the second wire 5 are included in an embodiment of the present disclosure as long as they are symmetrical as described above in a single turn of the stranded portion in which the first wire 4 and the second wire 5 are twisted together. However, as the number of turns for which the first wire 4 and the second wire 5 that are twisted together are symmetrical increases, the inductances and capacitances of the first wire 4 and the second wire 5 become more equivalent. Therefore, the first wire 4 and the second wire 5 are preferably symmetrical as described above over a plurality of turns of the stranded portion. More preferably, the first wire 4 and the second wire 5 are preferably symmetrical in substantially all of the turns of the stranded portion.

Figure 6:
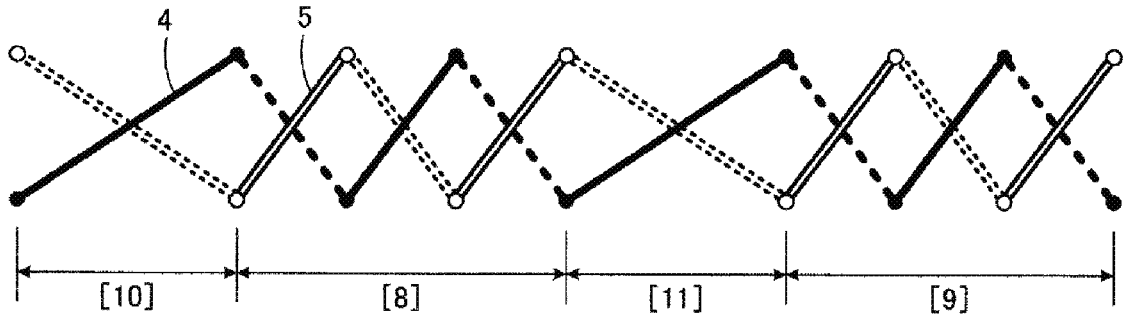
FIG. 6 is a diagram corresponding to FIG. 5, illustrating the manner in which first and second wires of a common-mode choke coil according to a comparative example are twisted together.

FIG. 6 is a diagram corresponding to FIG. 5, illustrating the manner in which a first wire 4 and a second wire 5 of a common-mode choke coil according to a comparative example are twisted together. In FIG. 6, components corresponding to the components illustrated in FIG. 5 are denoted by the same reference numerals, and redundant description is thus omitted. In the comparative example, the first wire 4 and the second wire 5 that are twisted together are not symmetrical.

More specifically, with regard to the first side surface 10 and the second side surface 11 that are opposite to each other, the number of times the first wire 4 is disposed outside the second wire 5 on the first side surface 10 is one. Also, the number of times the second wire 5 is disposed outside the first wire 4 on the second side surface 11 is zero.

Also, with regard to the top surface 8 and the bottom surface 9 that are opposite to each other, the number of times the first wire 4 is disposed outside the second wire 5 on the top surface 8 is one. Furthermore, the number of times the second wire 5 is disposed outside the first wire 4 on the bottom surface 9 is two.

On the top surface 8 and the bottom surface 9, the total number of times the first wire 4 is disposed outside the second wire 5 is two, and the total number of times the second wire 5 is disposed outside the first wire 4 is four. On the first and second side surfaces 10 and 11, the total number of times the first wire 4 is disposed outside the second wire 5 is two, and the total number of times the second wire 5 is disposed outside the first wire 4 is zero.

In the above-described arrangement, the number of times one of the first wire 4 and the second wire 5 is disposed outside the other differs between the surfaces that are opposite to each other. In this case, different stray capacitances are generated in the first wire 4 and the second wire 5. As a result, the signals transmitted through the first wire 4 and the second wire 5 are influenced by non-equivalent inductances and capacitances, and the mode conversion characteristics of the common-mode choke coil are degraded.

In the above-described first embodiment, the core 2 has a quadrangular shape with four straight sides in cross section perpendicular to the center axis of the core 2. However, modifications illustrated in FIGS. 7 to 10 are also possible. In FIGS. 7 to 10, components corresponding to the components illustrated in FIG. 3 are denoted by the same reference numerals, and redundant description is thus omitted.

Figure 7:
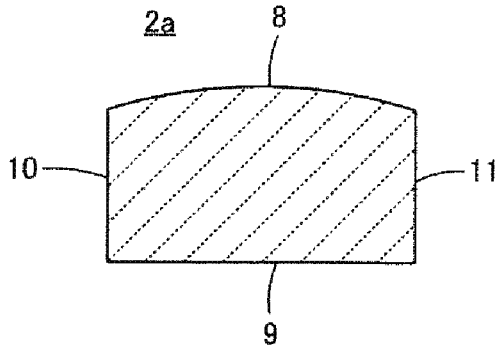
FIG. 7 is a sectional view of a core included in a common-mode choke coil according to a second embodiment of the present disclosure.

FIG. 7 illustrates a core 2*a* having a top surface 8 that is outwardly curved in cross section perpendicular to the center axis of the core 2*a*. The top surface 8 of the core 2*a* is not parallel to a flat bottom surface 9, but is opposite to the bottom surface 9.

Figure 8:
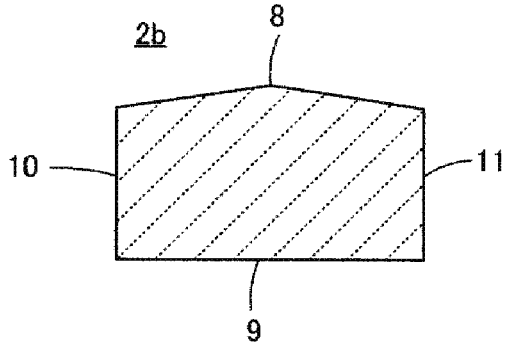
FIG. 8 is a sectional view of a core included in a common-mode choke coil according to a third embodiment of the present disclosure.

FIG. 8 illustrates a core 2*b* having a top surface 8 that is outwardly bent in cross section perpendicular to the center axis of the core 2*b*. Thus, the core 2*b* has a pentagonal cross section. The top surface 8 of the core 2*b* is bent and is not parallel to a flat bottom surface 9, but is opposite to the bottom surface 9.

Figure 9:
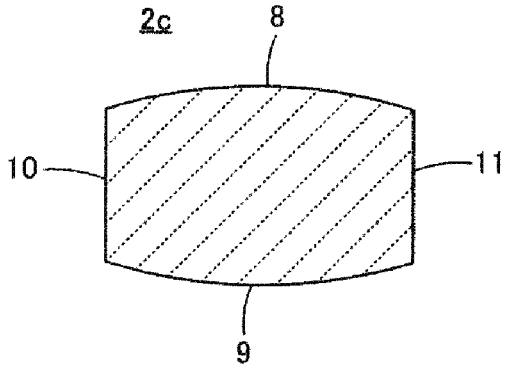
FIG. 9 is a sectional view of a core included in a common-mode choke coil according to a fourth embodiment of the present disclosure.

FIG. 9 illustrates a core 2*c* having not only a top surface 8 that is outwardly curved but also a bottom surface 9 that is outwardly curved in cross section perpendicular to the center axis of the core 2*c*. Accordingly, the top surface 8 and the bottom surface 9 are symmetrical in cross section perpendicular to the center axis. The top surface 8 of the core 2*c* is not parallel to the bottom surface 9, but is opposite to the bottom surface 9.

As a modification of the core 2*c* illustrated in FIG. 9, the top surface 8 and the bottom surface 9 may be curved to different extents.

Figure 10:
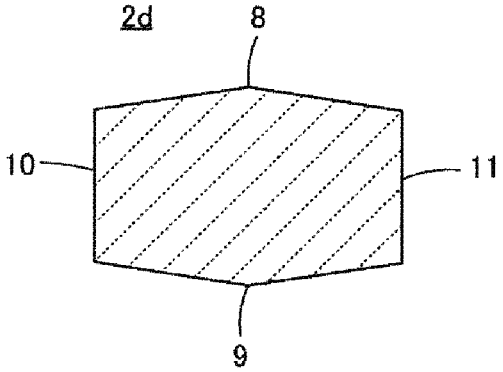
FIG. 10 is a sectional view of a core included in a common-mode choke coil according to a fifth embodiment of the present disclosure.

FIG. 10 illustrates a core 2*d* having not only a top surface 8 that is outwardly bent but also a bottom surface 9 that is outwardly bent in cross section perpendicular to the center axis of the core 2*d*. Thus, the core 2*d* has a hexagonal cross section. Accordingly, the top surface 8 and the bottom surface 9 are symmetrical in cross section perpendicular to the center axis. The top surface 8 of the core 2*d* is not parallel to the bottom surface 9, but is opposite to the bottom surface 9.

As a modification of the core 2*d* illustrated in FIG. 10, the top surface 8 and the bottom surface 9 may be bent to different extents.

In FIGS. 7 to 10, the corners between the sides of the cores 2*a* to 2*d* are not rounded. However, the corners between the sides may be rounded similarly to the core 2 illustrated in FIG. 3.

In the embodiments illustrated in FIGS. 7 to 10, the peripheral surfaces of the cores 2*a* to 2*d* are curved or bent. In such a case, the corners at the ridges between the peripheral surfaces become more obtuse in cross section. As a result, the stress applied to the wires is reduced so that the occurrence of damage, such as crazing, to the wires is reduced. Thus, the reliability of the common-mode choke coil is increased.

In addition, when the top surface 8 and the bottom surface 9 are not symmetrical as in the embodiments illustrated in FIGS. 7 and 8, resistance to bending due to stress applied from the bottom surface 9 can be increased.

In the embodiments illustrated in FIGS. 7 to 10, the top surface 8 or both the top and bottom surfaces 8 and 9 are outwardly curved or bent. In addition, the side surfaces 10 and 11 may also be outwardly curved or bent.

Although the embodiments of the present disclosure have been described with reference to the drawings, various modifications are possible within the scope of the present disclosure.

For example, although the stranded portion of the first wire 4 and the second wire 5 is wound around the core 2 in a single layer in FIGS. 1 to 3, the stranded portion may instead be wound around the core 2 in two or more layers.

When the number of layers is two or more, the first wire 4 and the second wire 5 that are twisted together are preferably symmetrical in each layer.

When the number of layers is two or more, the first wire 4 and the second wire 5 may be twisted together such that the first wire 4 and the second wire 5 are symmetrical in at least one of the layers. When, for example, the first wire 4 and the second wire 5 are symmetrical in the outermost layer, the first wire 4 and the second wire 5 are equivalently influenced by the objects around the common-mode choke coil 1, such as the mounting board and components adjacent to the common-mode choke coil 1. When the first wire 4 and the second wire 5 are symmetrical in an inner layer, the first wire 4 and the second wire 5 in the inner layer are equivalently influenced by the first wire 4 and the second wire 5 in the layers inside and outside the inner layer.

It is to be noted that the above-described embodiments are illustrative and that the structures in different embodiments may be partially replaced or combined.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A common-mode choke coil comprising:

a core having a shape that extends along a center axis and including peripheral surfaces around the center axis, the peripheral surfaces including a first surface and a second surface that are opposite to each other and a third surface and a fourth surface that are adjacent to the first surface and the second surface and opposite to each other; and a first wire and a second wire that are wound around the peripheral surfaces in same direction, that are not electrically connected to each other, and that are twisted together into a stranded portion, wherein, in one turn of the stranded portion, a number of times the first wire is disposed outside the second wire on the first surface is equal to a number of times the second wire is disposed outside the first wire on the second surface, and a number of times the first wire is disposed outside the second wire on the third surface is equal to a number of times the second wire is disposed outside the first wire on the fourth surface, the number of times the first wire is disposed outside the second wire on the first surface is different from a number of times the second wire is disposed outside the first wire on the first surface, the first surface and the second surface are symmetrical in cross section perpendicular to the center axis, and the first surface is outwardly bent and is not parallel in its entirety to the second surface in cross section perpendicular to the center axis.

2. The common-mode choke coil according to claim 1 wherein, in a plurality of turns of the stranded portion, a number of times the first wire is disposed outside the second wire on the first surface is equal to a number of times the second wire is disposed outside the first wire on the second surface, and a number of times the first wire is disposed outside the second wire on the third surface is equal to a number of times the second wire is disposed outside the first wire on the fourth surface.

3. The common-mode choke coil according to claim 1, wherein a number of twist of the stranded portion is two or less on each of the first surface, the second surface, the third surface, and the fourth surface.

4. The common-mode choke coil according to claim 1, wherein the core has a substantially quadrangular shape in cross section perpendicular to the center axis.

5. The common-mode choke coil according to claim 1, wherein the first surface is outwardly curved in cross section perpendicular to the center axis.

6. The common-mode choke coil according to claim 1, wherein the first surface is outwardly bent in cross section perpendicular to the center axis.

7. The common-mode choke coil according to claim 5, wherein the second surface is straight in cross section perpendicular to the center axis.

8. The common-mode choke coil according to claim 5, wherein the first surface and the second surface are symmetrical in cross section perpendicular to the center axis.

9. The common-mode choke coil according to claim 2, wherein a number of twist of the stranded portion is two or less on each of the first surface, the second surface, the third surface, and the fourth surface.

10. The common-mode choke coil according to claim 2, wherein the core has a substantially quadrangular shape in cross section perpendicular to the center axis.

11. The common-mode choke coil according to claim 3, wherein the core has a substantially quadrangular shape in cross section perpendicular to the center axis.

12. The common-mode choke coil according to claim 9, wherein the core has a substantially quadrangular shape in cross section perpendicular to the center axis.

13. The common-mode choke coil according to claim 2, wherein the first surface is outwardly curved in cross section perpendicular to the center axis.

14. The common-mode choke coil according to claim 3, wherein the first surface is outwardly curved in cross section perpendicular to the center axis.

15. The common-mode choke coil according to claim 9, wherein the first surface is outwardly curved in cross section perpendicular to the center axis.

16. The common-mode choke coil according to claim 2, wherein the first surface is outwardly bent in cross section perpendicular to the center axis.

17. The common-mode choke coil according to claim 3, wherein the first surface is outwardly bent in cross section perpendicular to the center axis.

18. The common-mode choke coil according to claim 6, wherein the second surface is straight in cross section perpendicular to the center axis.

19. The common-mode choke coil according to claim 1, wherein in the one turn of the stranded portion, the number of times the first wire is disposed outside the second wire along the center axis on the first surface is equal to the number of times the second wire is disposed outside the first wire along the center axis on the second surface, and the number of times the first wire is disposed outside the second wire along the center axis on the third surface is equal to the number of times the second wire is disposed outside the first wire along the center axis on the fourth surface.

20. A common-mode choke coil comprising:

a core having a shape that extends along a center axis and including peripheral surfaces around the center axis, the peripheral surfaces including a first surface and a second surface that are opposite to each other and a third surface and a fourth surface that are adjacent to the first surface and the second surface and opposite to each other; and a first wire and a second wire that are wound around the peripheral surfaces in same direction, that are not electrically connected to each other, and that are twisted together into a stranded portion, wherein, in one turn of the stranded portion, a number of times the first wire is disposed outside the second wire on the first surface is equal to a number of times the second wire is disposed outside the first wire on the second surface, and a number of times the first wire is disposed outside the second wire on the third surface is equal to a number of times the second wire is disposed outside the first wire on the fourth surface, the first surface and the second surface are symmetrical in cross section perpendicular to the center axis, and the first surface is outwardly bent and is not parallel in its entirety to the second surface in cross section perpendicular to the center axis.

21. A common-mode choke coil comprising:

a core having a shape that extends along a center axis and including peripheral surfaces around the center axis, the peripheral surfaces including a first surface and a second surface that are opposite to each other and a third surface and a fourth surface that are adjacent to the first surface and the second surface and opposite to each other; and a first wire and a second wire that are wound around the peripheral surfaces in same direction, that are not electrically connected to each other, and that are twisted together into a stranded portion, wherein, in one turn of the stranded portion, a number of times the first wire is disposed outside the second wire on the first surface is equal to a number of times the second wire is disposed outside the first wire on the second surface, and a number of times the first wire is disposed outside the second wire on the third surface is equal to a number of times the second wire is disposed outside the first wire on the fourth surface, the first surface and the second surface are symmetrical in cross section perpendicular to the center axis, and the first surface is outwardly bent so that the core has a hexagonal shape in cross section perpendicular to the center axis.

* * * * *